US005383745A

United States Patent [19]

Shannon

[11] Patent Number: 5,383,745

[45] Date of Patent: Jan. 24, 1995

[54] HAZARDOUS MATERIALS CATCH BASIN

[75] Inventor: John A. Shannon, Fremont, Calif.

[73] Assignee: John P. Deming, San Jose, Calif.

[21] Appl. No.: 986,804

[22] Filed: Dec. 8, 1992

[51] Int. Cl.[6] ..... E03F 1/00

[52] U.S. Cl. ..... 405/52; 210/164; 404/4; 588/249

[58] Field of Search ..... 588/249, 259; 405/36, 405/52, 128, 129; 210/163, 164, 170, 533; 137/312; 404/2, 3, 4, 5

[56] References Cited

U.S. PATENT DOCUMENTS

| | | | |
|---|---|---|---|
| 2,246,390 | 6/1941 | Smith | 210/164 X |
| 2,504,474 | 4/1950 | Van Oss | 210/163 X |
| 4,136,010 | 1/1979 | Pilie et al. | 210/164 |
| 4,348,279 | 9/1982 | Tikhonov et al. | 210/533 X |
| 4,419,232 | 12/1983 | Arntyr et al. | 210/164 |
| 4,650,365 | 3/1987 | Runnels | 404/4 X |
| 4,971,477 | 11/1990 | Webb et al. | 405/52 X |
| 4,986,907 | 1/1991 | Uzeta | 210/533 X |
| 5,092,251 | 3/1992 | Hamaker et al. | 108/51.1 |
| 5,117,877 | 6/1992 | Sharp | 405/52 X |

*Primary Examiner*—David H. Corbin
*Attorney, Agent, or Firm*—Fliesler, Dubb, Meyer & Lovejoy

[57] ABSTRACT

A catch basin for collecting hazardous materials in a drain comprises a container having a drain hole, an annular flange extending from the upper edge of the container for supporting the container in a drain, a cover member having a plurality of through-holes and a drain plug which is threadably inserted in a drain hole provided therefore in the bottom of the container for use in plugging the container to contain hazardous materials.

8 Claims, 2 Drawing Sheets

HAZARDOUS MATERIALS CATCH BASIN

BACKGROUND OF THE INVENTION

1. Field of the Invention

The present invention relates to apparatus for handling hazardous materials in general and in particular to a catch basin with a removable drain plug designed for placement in a storm drain or other type of drain for catching accidental spills of hazardous materials.

2. Description of the Related Art

Among the most serious problems associated with the handling of hazardous materials is the accidental discharge of such materials into a drain which leads to a sewage treatment plant which is not equipped to handle such materials or into a storm drain which ultimately flows into a creek, river, lake, bay, or the like. In either case, the cost of containing and cleaning up the material can be enormous both financially and in terms of the negative impact on the environment.

The manufacture of semiconductor products, for example, involves the use of hazardous materials which are usually stored in exterior tanks outside the walls of the manufacturing facility. Not infrequently, storm drains and the like which are used to collect rain water are found in the vicinity of the exterior storage tanks.

The material in the tanks is periodically replenished from a tanker truck or the like. If through negligence or by accident the material is spilled on the ground during the filling of the tanks, it could be collected by a nearby storm drain, resulting in the above-described adverse consequences.

Presently, companies seek to prevent the loss of hazardous materials in a storm drain by covering the drain with an absorbent blanket, such as a Spill Mat made by Lab Safety Supply of Janesville, Wis., or by surrounding the drain with piles of absorbent material, such as Safe-T-Sorb, available from Orchard Supply Hardware, Sunnyvale, Calif., either before an accidental spill as a preventive measure or afterwards to minimize the damage caused by the spill. Sometimes the edges of the blanket are required to be held down by some sort of heavy object such as, for example, bags of absorbent material.

When the spilled material is a liquid, the use of a bag of absorbent material, or the like, to prevent the liquid material from flowing beneath the edges of the blanket is not always successful. Furthermore, the absorbent blankets which are currently being used for this purpose are expensive and must be replaced as soon as they have become saturated with any liquid, including ordinary rainwater, because, after they are saturated, they no longer will hold any additional liquid. Also the need to hold down the edges with heavy objects is time consuming and labor intensive. Moreover, when not used to cover a drain, the blanket is usually stored in a pile immediately adjacent to the drain and is therefore unsightly. Alternatively, if the drain is in a traffic area and the blanket poses an obstacle to traffic, the blanket must be stored some distance from the drain and is therefore more likely not to be immediately available for use in case of a spill.

When loose material is used to absorb a spill, the material must be cleaned up after a spill or even after a rain. In the interim, the area is unsightly and loose particles of the absorbent material can wash down the drain.

SUMMARY OF THE INVENTION

In view of the foregoing, a principal object of the present invention is a catch basin having a removable drain plug which is designed to be inserted in an existing storm drain for collecting hazardous material which is accidentally spilled.

In accordance with the above object a catch basin is provided in one embodiment thereof which comprises a generally cylindrical container having a removable threaded drain plug in the center of the bottom thereof, an annular flange extending radially outwardly from the top edge of the container for supporting the container on a corresponding annular shoulder in an existing storm drain and a cover member having a plurality of through-holes which is supported on an annular shoulder interior and flush with the top of the annular flange.

The removable drain plug comprises a cylindrical body member, a threaded male portion at the lower end of the body member and a T-shaped handle at the upper end of the body member which is formed by inserting a dowel-shaped member through the body member. The T-shaped handle facilitates the insertion and removal of the drain plug.

In another embodiment of the present invention, the drain plug comprises an electrically operated solenoid having a plunger at the end of an armature for plugging the drain hole in the container in response to either a manually or automatically generated control signal.

BRIEF DESCRIPTION OF THE DRAWINGS

The above and other objects, features and advantages of the present invention will become apparent from the following detailed description of the accompanying drawings, in which.

DESCRIPTION OF THE PREFERRED EMBODIMENTS

Figure 2:
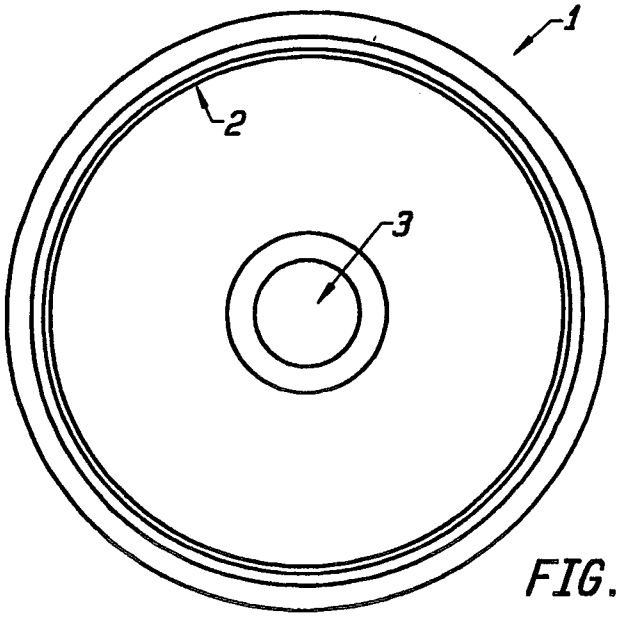
FIG. 2 is a top plan view of FIG. 1.
Figure 1:
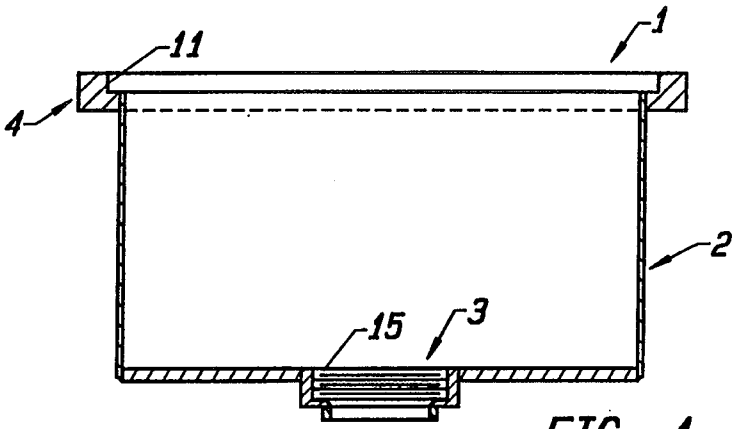
FIG. 1 is a side cross-sectional view of a catch basin according to the present invention.
Figure 3:
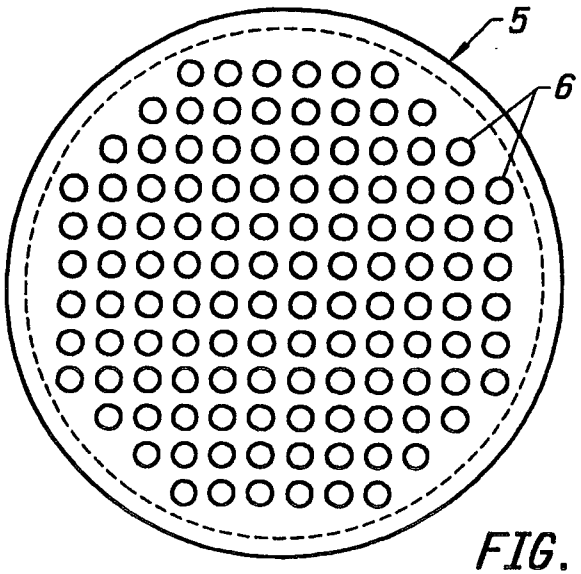
FIG. 3 is a top plan view of a cover member according to the present invention.

Referring to FIGS. 1–5, there is provided in accordance with the present invention a catch basin designated generally as 1 for collecting hazardous materials in a storm drain. The basin 1 comprises a generally cylindrical container 2 having a drain hole 3, an annular flange 4 which extends radially outwardly from the top of the container 2 for mating with a corresponding shoulder of a storm drain for supporting the container 2 in the storm drain, a cover member 5 comprising a plurality of through-holes 6 and a drain plug 7 for plugging the drain hole 3.

Figure 4:
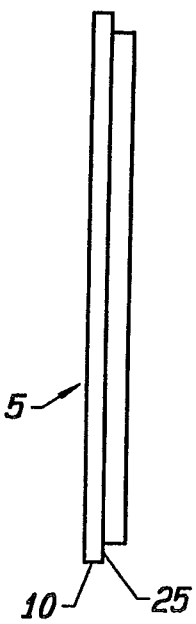
FIG. 4 is a side elevation view of FIG. 3.

As seen more clearly in FIG. 4, the cover member 5 comprises an extended annular upper portion about the periphery thereof forming a flange 10 having an undersurface 25. The flange 10 is provided to mate with an annular shoulder 11 at the top of the container 2 in the interior wall of the flange 4 such that the upper surface of the cover 5 is flush with the upper surface of the flange 4 when the cover member 5 is in place.

The drain hole 3 comprises conventional pipe threads 15 for threadably receiving the drain plug 7.

Figure 5:
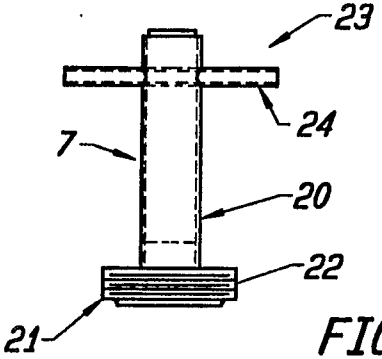
FIG. 5 is a side elevation view of a drain plug according to the present invention.

Referring to FIG. 5, the drain plug 7 comprises an elongated body member 20. Located at the lower end of the body member 20 there is provided an enlarged cylindrical portion 21 comprising conventional pipe threads 22 which correspond to the threads 15 in the drain hole 3. At the upper end of the body member 20 there is provided a T-shaped handle 23. The handle 23 is formed by passing a predetermined length of tubular material 24 through a hole provided therefor near the upper end of the body member 20.

The catch basin 1 and each of the parts thereof is typically made from polypropylene material which is the material of choice for handling many hazardous materials used in the fabrication of semiconductor products. Of course, other materials may be used so long as they are not destroyed by the hazardous materials with which they may come in contact. Such materials may comprise, for example, stainless steel and chemically resistant epoxy coated steel, and the like.

The dimensions of the catch basin of the present invention as shown in FIGS. 1–5 are for a typical conventional storm drain having a diameter of approximately 21 inches. Of course, for larger or smaller storm drains appropriate changes in the dimensions shown may be made.

To use the catch basin of the present invention in a conventional storm drain, the cast iron cover, or the like, which is normally supplied with a conventional storm drain, is removed and can be discarded. To insure a good watertight fit, a bead of caulking compound such as marine caulking used for boats, is placed on the shoulder on which the cast iron cover rested to provide a good watertight seal between the undersurface 25 of the flange 4 and the shoulder of the storm drain on which the flange 4 is seated. The container 2 is then lowered into the storm drain pipe so that the base of the flange 4 comes to rest on the shoulder which supported the conventional cast iron cover supplied with the conventional storm drain. The cover 5 is then put in place such that the lower surface 25 of the extended portion 10 of the cover member 5 rests on the shoulder 11 formed in the interior wall of the flange 4. The drain plug 7 may be inserted in the drain hole 3 before the cover 5 is placed on the container 2 or it may be left lying in the bottom of the container 2 for later use in plugging the hole 3 in the event of a spill of hazardous materials in the vicinity of the storm drain.

Figure 7:
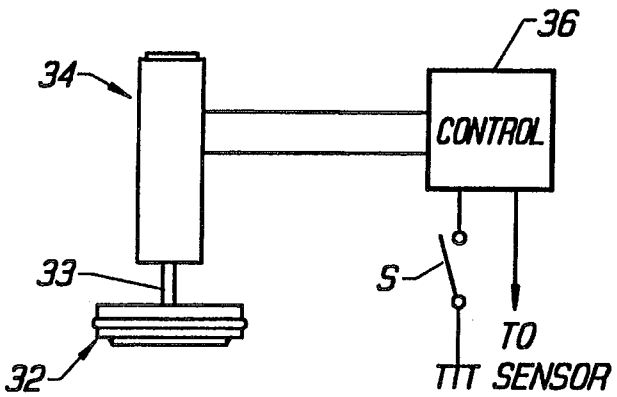
FIG. 7 is a side elevation view of a solenoid operated drain plug according to the present invention.
Figure 6:
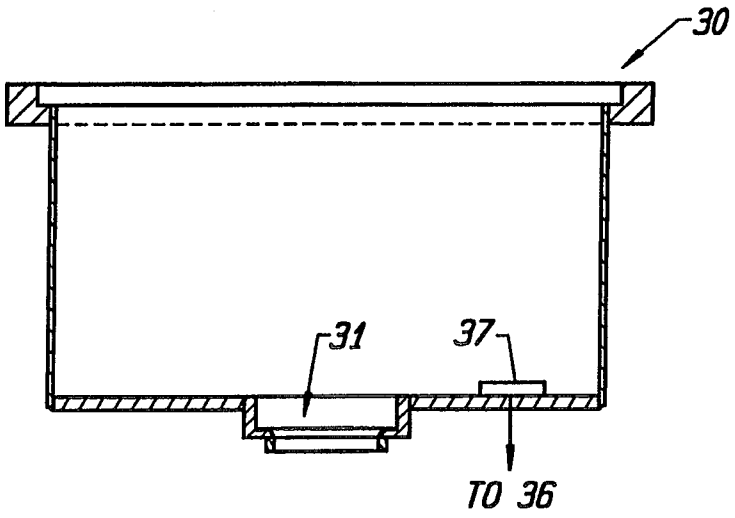
FIG. 6 is a side cross-sectional view of a catch basin according to another embodiment of the present invention.

Referring to FIGS. 6 and 7, there is provided in an alternative embodiment of the present invention a container 30 which is identical to the container 2, but which comprises a modified drain hole 31 adapted to receive the plunger 32 at the end of an armature 33 of an electrically operated solenoid 34. The plunger 32 is provided with an O-ring 35 for forming a watertight seal with the walls of the drain hole 31. A control circuit 36 is provided for controlling the operation of the solenoid.

The solenoid 34 can be operated in different ways. For example, the drain hole 31 could be normally closed until a signal from the control circuit 36 sends a signal to the solenoid 34 causing the solenoid 34 to withdraw the plunger 32 from the hole 31. Alternately, the control circuit 36 could hold the solenoid plunger out of the drain hole 31 against the force of a spring so that the plunger would close the drain hole 31 whenever the holding signal was terminated either deliberately or upon a power failure, a type of fail-safe control.

The control circuit 36 may be made responsive to a manual input, such as the closing of a switch S as shown in FIG. 7 and/or an automatic input in response to the output of a sensor of hazardous materials 37, such as shown in FIG. 6.

While preferred embodiments of the present invention are described above, it is contemplated that numerous modifications may be made thereto for particular applications without departing from the spirit and scope of the present invention. For example, square and rectangular catch basins may be made for square and rectangular drains. Moreover, the drains in which the invention may be used is not limited to storm drains. Accordingly, it is intended that the embodiments described be considered only as illustrative of the present invention and that the scope thereof should not be limited thereto but be determined by reference to the claims hereinafter provided.

What is claimed is:

1. A catch basin for insertion in a pre-existing storm drain for collecting hazardous materials in said storm drain, said storm drain having a shoulder for supporting a pre-existing storm drain cover member, comprising:

a rigid liquid impermeable container having a drain hole and an L-shaped annular flange which extends radially outwardly from the top of said container, said L-shaped annular flange having a vertically extending member, a lower horizontal surface which extends outwardly beneath said vertically extending member for mating with the shoulder of the pre-existing storm drain in place of the pre-existing storm drain cover member and an upper horizontal surface which extends inwardly from said vertically extending member for supporting a catch basin cover member;

said catch basin cover member having a lower surface and a diameter suitable for mating with said upper horizontal surface of said L-shaped annular flange and a thickness such that, when in place, said catch basin cover member is flush with the top of said L-shaped annular flange, said catch basin cover member having a plurality of through-holes; and means for plugging the drain hole in the container.

2. A catch basin according to claim 1 wherein said drain hole in said container comprises a drain hole having interior threads and said plugging means comprises means having exterior threads for threadably engaging the interior threads of the drain hole and means for facilitating the insertion of said plugging means into and the removal of said plugging means from the drain hole.

3. A catch basin according to claim 1 wherein said plugging means comprises:

an elongated body member; and means located at the lower end of said body member having exterior threads for engaging corresponding interior threads in said drain hole in said container; and means located near the upper end of said body member for providing a T-shaped handle to facilitate the insertion of said plugging means into and the removal of said plugging means from said drain hole in said container.

4. A catch basin according to claim 1 wherein all of the parts thereof comprise polypropylene.

5. A catch basin according to claim 1 wherein said catch basin cover member is at least 1.5 inches thick and said plurality of through-holes comprises a plurality of through-holes approximately 1.0 inches in diameter and having centers approximately 1.5 inches apart.

6. A catch basin according to claim 1 wherein said plugging means comprises an electrically operated solenoid responsive to a control signal.

7. A catch basin according to claim 6 wherein said control signal comprises a manually generated control signal.

8. A catch basin according to claim 6 wherein said control signal comprises an automatically generated control signal.

* * * * *